US005950241A

United States Patent [19]

Gomez

[11] Patent Number: 5,950,241

[45] Date of Patent: Sep. 14, 1999

[54] HAT WITH TWIST FOLDING BRIM AND DRAPE

[76] Inventor: Anna Maria D. Gomez, 855 Richardson La., Cotati, Calif. 94931

[21] Appl. No.: 09/093,788

[22] Filed: Jun. 9, 1998

[51] Int. Cl.[6] ..... A42B 1/06

[52] U.S. Cl. ..... 2/172; 2/209.13

[58] Field of Search ..... 2/4, 172, 209.13, 2/173, 175.6, 206, 207, 424

[56] References Cited

U.S. PATENT DOCUMENTS

| | | | |
|---|---|---|---|
| D. 337,645 | 7/1993 | Guziejka | D2/884 |
| 822,986 | 6/1906 | Rochet . | |
| 1,706,205 | 3/1929 | Alonzo | 2/172 |
| 1,780,801 | 11/1930 | Shlenker | 2/4 |
| 2,897,510 | 8/1959 | Forbes-Robinson . | |
| 3,469,264 | 9/1969 | Harris . | |
| 3,496,574 | 2/1970 | Liverant . | |
| 4,057,855 | 11/1977 | Hovhannessian . | |
| 4,096,590 | 6/1978 | Keshock . | |
| 4,131,954 | 1/1979 | Brock et al. . | |
| 4,999,851 | 3/1991 | Hall . | |
| 5,081,717 | 1/1992 | Shedd et al. . | |
| 5,212,837 | 5/1993 | Gose et al. . | |
| 5,287,561 | 2/1994 | Spector . | |
| 5,367,706 | 11/1994 | Davidson . | |
| 5,406,645 | 4/1995 | Lin | 2/209.13 |
| 5,448,778 | 9/1995 | Phillips . | |
| 5,450,629 | 9/1995 | Gilstrap . | |
| 5,488,740 | 2/1996 | Garza . | |
| 5,548,846 | 8/1996 | Bianchetti | 2/209.13 |
| 5,579,540 | 12/1996 | Walker . | |
| 5,713,076 | 2/1998 | Davis | 2/4 |

FOREIGN PATENT DOCUMENTS

| | | |
|---|---|---|
| 153025 | 8/1953 | Australia . |
| 787503 | 9/1935 | France . |
| 1031469 | 3/1953 | France . |
| 1472626 | 3/1967 | France . |
| 358061 | 8/1938 | Italy . |
| 666164 | 7/1988 | Switzerland . |

*Primary Examiner*—Diana L. Oleksa
*Attorney, Agent, or Firm*—Richard C. Litman

[57] ABSTRACT

A hat having a twist folding brim includes a drape depending from the outer periphery of the brim. The outer periphery of the brim also includes a stiff but flexible member therein, enabling the brim to be twisted and folded over for compact storage of the hat with its attached brim and drape. The drape provides good air circulation about the back of the neck of a wearer of the present hat, due to its distance from the wearer from depending from the outer edge of the relatively wide brim of the hat. The drape also serves to shield the wearer from the sun and other environmental effects. The drape may be permanently or removably attached to the brim of the hat, and may be made in virtually any practicable length, width, and/or material as desired. Adjustment for the length and/or width may also be provided with the hat. The drape may be formed of water resistant, waterproof, or water absorbent materials, with water absorbent drapes providing an evaporative cooling effect when moistened. A scent may be added to such absorbent drapes, to scent the surrounding air as desired. The drape may include some form of display on the back (advertising, etc.) if so desired, either in two dimensional or three dimensional (e. g., relief) form as desired.

8 Claims, 3 Drawing Sheets

HAT WITH TWIST FOLDING BRIM AND DRAPE

BACKGROUND OF THE INVENTION

1. Field of the Invention

The present invention relates generally to hats, caps, and other headgear, and more particularly to a hat having a relatively wide brim with a drape depending from the outer edge of the brim. The brim also includes a relatively stiff but flexible circumferential member, allowing the brim to be twisted generally in a figure eight pattern and folded over for storage of the hat.

2. Description of the Related Art

Innumerable different types of hats, caps, and headgear have been developed over the years. A relatively recent development has been the hat with a relatively wide brim, with the brim including a circumferential flexible stiffening member therearound. The compact storage of such devices by twisting into a figure eight pattern and then doubling over the eight to form two loops each having less than half the diameter of the original, has been known for quite some time, as many articles (surveyor's tapes, etc.) are commonly stored in this manner. Such articles can be twisted into more than two loops and folded over accordingly for even more compact storage, if desired.

Another branch of the field of hats and headgear has involved the inclusion of some form of drape depending from the crown or hatband of the hat or cap. The classic "French Foreign Legion" cap is an old example of such caps with rearwardly depending drapes. While such drapes do provide some protection from the sun and environment to the back of the neck, their extremely close proximity to the back of the neck due to their depending directly from the hatband of the hat or cap, precludes significant circulation of air about the back of the neck, thus failing to provide the degree of comfort which might be desired. Yet, most such hats and caps do not have a brim which completely surrounds the crown of the hat, as most are adapted for relatively compact storage and a wide surrounding brim generally precludes such compact storage, with the exception of hats constructed with twist folding brims as recognized above.

Accordingly, a need will be seen for a hat having a relatively wide, twist folding brim for good protection from the sun and environment, which hat further includes a drape. Unlike hats with drapes of the prior art, the present drape extends from the outer edge of the brim, rather than from the hatband or edge of the crown portion of the hat. This positions the drape well away from the neck of the wearer of the hat, thus providing good air circulation between the back of the neck or other area of the wearer of the hat, and the drape. Yet, the drape thus positioned still provides good protection from the sun and environment, and serves to shade the back of the neck of the wearer of the hat. The brim with its circumferential twist folding member, provides for compact storage of the hat, brim, and drape when the hat is not needed.

A discussion of the related art of which the present inventor is aware, and its differences and distinctions from the present invention, is provided below.

U.S. Pat. No. 822,986 issued on Jun. 12, 1906 to Jean Rochet, titled "Head And Nape Covering," describes a hat having a "nape-covering" or drape for the back of the neck. The drape is permanently affixed to the back of the hat band portion of the cap, and cannot be removed. FIGS. 1 through 4 of the Rochet patent. illustrate a cap resembling the classing French Foreign Legion style cap, while FIGS. 5 and 6 illustrate a cap with a relatively wider circular crown. Each of the embodiments describes a cap having only a partial forward brim, or bill, with the drape depending from the rear of the hat band, unlike the present drape which depends from the edge of the brim. No twist folding action is provided for the Rochet caps.

U.S. Pat. No. 2,897,510 issued on Aug. 4, 1959 to Christina E. Forbes-Robinson, titled "Sports Cap Or Hat Accessory," describes a cap having a low crown and partial forward brim, or bill. The rear portion of the crown includes a hair shield or drape which depends from the band portion of the hat. The cap more closely resembles the cap of FIGS. 1 through 4 of the Rochet patent than the present hat with brim and drape, as only a partial brim or bill is provided. The drape is permanently attached to the back of the hat band, and no twist folding of the hat is disclosed, unlike the twist folding provided for the present hat invention.

U.S. Pat. No. 3,469,264 issued on Sep. 30, 1969 to Charles J. Harris, titled "Plastic Rainwear Hood," describes a hood, including a drape, which is formed to fit over a baseball style cap having a generally hemispherical crown. The hood may be worn alone, or over such a cap as desired. The drape portion of the headgear is permanently attached to the band portion of the cap, with the only brim disclosed being a relatively short and narrow bill extending only over the face of the wearer. No broad, circumferential brim is disclosed, nor is any means of twist folding the brim for compact storage, as provided by the present invention.

U.S. Pat. No. 3,496,574 issued on Feb. 24, 1970 to Irvin Liverant, titled "Folding Hat And Integral Hat Crown-Shaping And Hat-Storing Device," describes a hat having a twist folding, circular brim with a low, generally cylindrical crown portion. The crown is adapted to carry and store an envelope for the hat when the hat is in an opened configuration for wearing, with the envelope being removed from the inside of the crown and used for storing the twist folded brim and folded crown for storage. No drape, either permanently attached or removable, is disclosed in the Liverant patent.

U.S. Pat. No. 4,057,855 issued on Nov. 15, 1977 to Karnig Hovhannessian, titled "Adjustable Sun Hat," describes a radially pleated, umbrella-like shade which is adjustably attached to a head band arrangement. No twist folding brim, or drape extending from such a brim, is disclosed by Hovhannessian.

U.S. Pat. No. 4,096,590 issued on Jun. 27, 1978 to Edward G. Keshock, titled "Collapsible Hat," describes a hat having a relatively wide brim with a circumferential flexible stiffening member therein. The brim material is cut to stress the stiffening member so the brim is bistable, having alternate turned up and turned down areas normal to one another. The flexible stiffening member provides for the brim and crown to be twist folded for storage, in this case by forming triple loops of the brim band member and corresponding folding of the hat material. However, Keshock does not disclose any form of drape with his hat.

U.S. Patent No. 4,131,954 issued on Jan. 2, 1979 to Louis C. Brock et al., titled "Collapsible Headgear," describes a hat having an umbrella-like shade extending upwardly on a frame from a headband. The shade folds essentially as an umbrella, with no twisting action provided. While the deployed shade essentially forms a continuous, raised brim-like expanse above the wearer's head, with no separate crown portion extending thereabove, no drape or twist-folding action of the device is disclosed.

U.S. Pat. No. 4,999,851 issued on Mar. 19, 1991 to Douglass A. Hall, titled "Collapsible Hat," describes a hat with a brim having a circumferential flexible stiffening member therein. The ends of the brim stiffening member are captured adjacent one another, but are free to rotate axially relative to one another for greater freedom of motion. Hall provides for either double or triple twist folding of his brim and hat, but does not disclose any form of drape depending from any point or area of his hat.

U.S. Pat. No. 5,081,717 issued on Jan. 21, 1992 to Aaron N. Shedd et al., titled "Headgear Attachment," describes a drape which is removably attachable to the back of the headband or periphery of a close fitting cap. While the conventional cap disclosed includes a front brim or bill, no suggestion is made for attaching the Shedd et al. removable drape to this portion of the cap to space the drape away from the skin of the cap wearer.

U.S. Pat. No. 5,212,837 issued on May 25, 1993 to Richard V. Gose et al., titled "Protective Clothing Accessory," describes a drape and head band which may be applied about the upper head, with a hat being placed over the upper edge of the drape. Gose et al. also provides for their drape to be removably attached to the headband of existing headgear. However, Gose et al. are silent regarding the use of their drape with a hat having a brim; no use of the Gose et al. drape depending from the outer edge of an extended hat brim is disclosed.

U.S. Pat. No. 5,287,561 issued on Feb. 22, 1994 to Donald Spector, titled "Convertible Fabric Hat And Package Therefor," describes a hat having a relatively wide circumferential brim and a double crown. The space between the two crowns may be inflated, causing the second crown to expand to a convex shape and the center of the hat to form a generally spherical shape. The Spector hat may be tossed as a toy in this configuration. Spector does not disclose any form of drape which may be removably or permanently attached to the outer circumference of the brim of his hat.

U.S. Pat. No. 5,367,706 issued on Nov. 29, 1994 to Norma J. Davidson, titled "Collapsible Headnet," describes a generally cylindrical net with a closed top and a generally medial circumferential flexible stiffening member. The stiffening member does not define the outer edge of a brim, but rather expands the net to hold the net away from the wearer's face. The stiffening member may be twist folded for compact storage of the Davidson net. However, the Davidson device is not actually a hat for covering the top of the head, but is rather a net to cover and enclose the entire head, face, and neck in order to prevent insect bites and the like. No extended brim, or drape depending from such a brim, is disclosed by Davidson.

U.S. Pat. No. 5,448,778 issued on Sep. 12, 1995 to Bradway F. Phillips, titled "Detachable Sun Shield For Caps," describes a drape for removable attachment to a conventional baseball type cap having a forward brim or bill and an adjustable headband. The drape is placed over the cap, with the forward portion of the drape band extending across the forward portion of the cap above the bill. The adjustable headband components may be separated and inserted into slits in the band of the drape at the rear of the cap. The drape thus depends from the headband of the cap, rather than from any extended brim portion, as in the present hat invention. Phillips does not disclose any twist folding means for the cap, nor any means of securing the drape to depend from the brim or bill portion of the cap.

U.S. Pat. No. 5,450,629 issued on Sep. 19, 1995 to Keith D. Gilstrap, titled "Convertible Hat With A Foldable Visor And Associated Method," describes a baseball style cap having a generally hemispherical crown portion with a bill or visor extending from the forward circumferential edge thereof. The visor includes a series of transverse fold lines, for folding the visor and tucking it into the crown portion for compact storage of the hat when not being worn. No twist folding or circumferential brim is disclosed, nor is any form of either permanently or removably attached drape depending from such a brim, disclosed by Gilstrap.

U.S. Pat. No. 5,488,740 issued on Feb. 6, 1996 to Irene E. Garza, titled "Reversible And Size Adjustable Hat," describes a hat having a double crown and brim, with the hat providing for eversion to exchange the inner and outer portions of the crown and brim. No twist folding of the brim and hat is disclosed, nor does Garza disclose any form of drape depending from the brim or elsewhere from the hat.

U.S. Pat. No. 5,579,540 issued on Dec. 3, 1996 to Janice Walker, titled "Hat/Bag Combination," describes a hat having doubled crown and brim surfaces for reversibility of the hat. The construction of the hat permits the brim to be concealed either partially or completely within the hat, with a drawstring about the headband permitting further folding or closure of the hat. No twist folding means is disclosed, nor does Walker disclose any provision for a drape either removably or permanently attached to the outer edge of the brim or any other portion of the hat.

French Patent Publication No. 787,503 published on Sep. 24, 1935 illustrates a hat with the brim apparently including an outer periphery with a stiff, flexible band therein. FIG. 3 of the French Patent Publication appears to show the triple twist folding of the band, brim, and hat for storage-However, no drape depending from any portion of the crown or brim of the hat, is disclosed.

Italian Patent Publication No. 358,061 published in August, 1938 illustrates a hat apparently including a relatively wide brim with a band providing for twist folding of the brim and hat. While a carrying loop or handle appears to be illustrated, no disclosure is apparent of any form of drape depending from any part of the hat.

French Patent Publication No. 1,031,469 published on Mar. 18, 1953 illustrates a hat having a relatively wide brim including a circumferential stiff, flexible member therein. The hat and brim may be twist folded to form three loops for compact storage. The ends of the brim member are captured relative to one another, but are free to rotate axially relative to one another for greater flexibility. However, the hat of the '469 French Patent Publication does not disclose any form of drape depending from any portion of the hat or brim.

Australian Patent Publication No. 153,025 published on Aug. 31, 1953 illustrates a hat essentially identical to that of the '469 French Patent Publication discussed immediately above, to the same inventor. The same differences from the present invention apply.

French Patent Publication No. 1,472,626 published on Mar. 10, 1967 illustrates a hat including a brim and removable draw string. The draw string may be carried within the crown of the hat, and removed from the crown and installed within the outer edge of the brim in order to use the hat as a handbag or the like. No means for twist folding the brim for compact storage of the hat is apparent, nor is any drape depending from any portion of the hat, apparent.

Finally, Swiss Patent Publication No. 666,164 published on Jul. 15, 1988 illustrates a hat with a relatively wide brim including a flexible member in the outer edge thereof for twist folding the brim and hat for compact storage. No form of drape depending from any part of the hat, is disclosed.

None of the above inventions and patents, taken either singly or in combination, is seen to describe the instant invention as claimed.

SUMMARY OF THE INVENTION

The present invention comprises a hat having a relatively wide brim which completely encircles the central crown portion thereof. The brim includes a thin, stiff but flexible band disposed within a circumferential seam or pocket within the outer edge of the brim. The band provides for the twist folding of the brim and crown of the hat for compact storage of the hat when it is not being worn.

The brim also includes a drape or sun shield which may be either permanently or removably secured thereto, with the drape depending from the outer edge of the brim. The hat may include provision for adjustably extending the drape further about the periphery of the brim, as desired, and the drape may be provided in any practicable length as desired. Means for adjusting the length and width of the drape may also be provided. The drape may be formed of any of a number of translucent or opaque materials, and may be formed of waterproof or water resistant materials, if so desired. Alternatively, the drape may be formed of moisture absorbent materials and used for evaporative cooling of the adjacent air, if desired. Other scented substances may be mixed with the coolant liquid or disposed in the drape without dilution as desired, to scent the surrounding air. The drape may also include display means thereon, in either two dimensional (flat) or three dimensional (relief, etc.) forms.

Accordingly, it is a principal object of the invention to provide an improved hat with a twist folding brim completely surrounding a central crown, and a drape depending from the outer periphery of the brim.

It is another object of the invention to provide an improved hat with a twist folding brim and drape, including means for the removable attachment of the drape to the brim.

It is a further object of the invention to provide an improved hat with a twist folding brim and drape, which drape may be formed of any practicable material, width, and length as desired.

An additional object of the invention is to provide an improved hat with a twist folding brim and drape, including means for adjusting the width and/or length of the drape as desired.

Still another object of the invention is to provide an improved hat with a twist folding brim and drape, which drape may be waterproof, water resistant, or water absorbent to provide for evaporative cooling and/or scent dispensing as desired.

Yet another object of the present invention is to provide an improved hat with a twist folding brim and drape, including two dimensional and three dimensional display means thereon.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
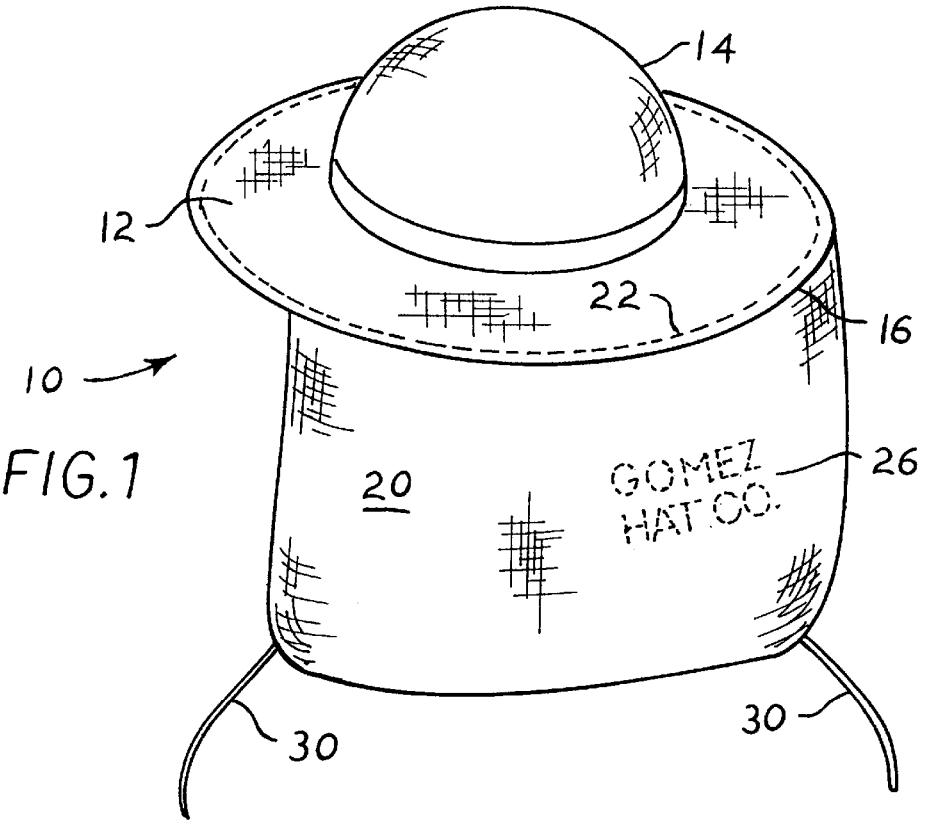
FIG. 1 is a rear perspective view of the present hat with a twist folding brim and drape, showing its general configuration and two dimensional display means on the drape.
Figure 2:
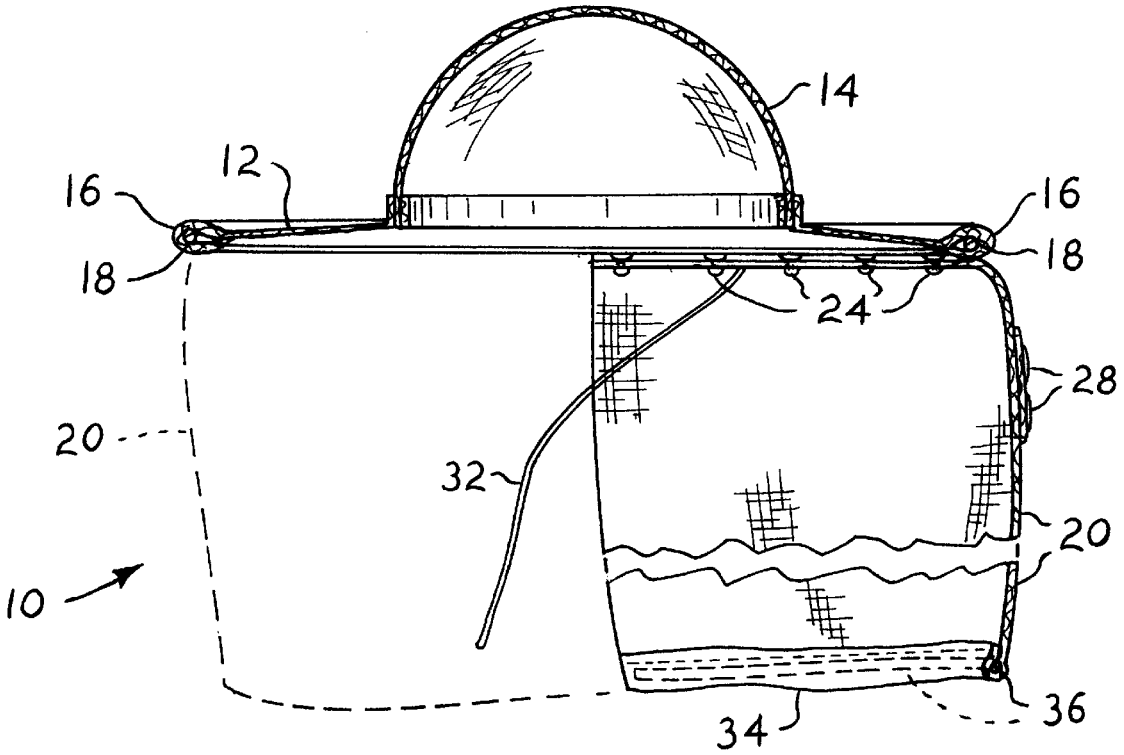
FIG. 2 is a left side elevation view in section of the present hat with brim and drape invention, showing means for removably securing the drape to the hat brim and for adjusting the length of the drape and weighting the lower edge of the drape.

The present invention comprises a hat or headgear, a first embodiment of which is shown in FIG. 1 and designated by the reference numeral 10. The hat 10 of the present invention includes a relatively wide brim portion 12, which completely encircles the central crown portion 14. The brim 12 has an outer peripheral edge 16, which includes a stiff but flexible band or member 18 disposed therein (e. g., sewn into a peripheral seam, as shown in FIG. 2, etc.). The outer peripheral edge 16 of the brim 12 also includes a drape 20 depending from at least the rear portion of the brim 12.

The drape 20 of the hat 10 of FIG. 1 may be permanently attached to the outer edge 16 of the brim 12, e. g., by sewing to the outer edge 16 stitching 22 used to capture the flexible band or member 18 therein. Alternatively, the drape 20 may be removably secured to the brim 12 outer edge 16, e. g., by means of snap fasteners 24 as shown in FIG. 2, or by any other suitable means (buttons, cooperating hook and loop fabric material, e. g., Velcro; tm, etc.).

The present drape 20 may extend about any portion of the outer edge 16 of the brim 12, as desired. In the examples shown in FIGS. 1 and 2, the drape 20 extends about approximately the rearward half of the circumference of the brim 12. However, it will be seen that the drape 20 could be made much narrower, if desired, and secured to the rearmost portion of the outer edge 16 of the brim 12, if so desire, or to any other point along the outer edge 16 of the brim 12. It will also be seen that the drape 20 could be made to extend further around the outer periphery 16 of the brim 12, if so desired, as indicated by the broken line showing of the drape extension in FIG. 2.

The present drape 20 may be formed of any of a number of suitable materials, depending upon the specific desired function(s) of the hat 10 with its drape 20. The only real requirement for the drape 20 material is that it be suitably flexible to provide for folding and storage of the drape 20 with its hat 10.

For example, if maximum protection from the sun and solar radiation is desired, the drape 20 could be formed of a thin, reflective aluminized material (e. g., Mylar, tm). A continuous, nonwoven sheet of such material, or other plastic material, also provides a waterproof shield for use as rainwear or in other inclement conditions. Other materials (natural or synthetic leather, plastic or elastomer coated fabrics, etc.) could also be used to form the drape 20.

However, it is anticipated that the drape 20 would be formed primarily of woven fabric materials, due to their economy, light so weight, flexibility and foldability, and other properties desirable in the environment of the present hat and drape 10. Such woven fabrics also provide significant protection from the sun, and are also moisture absorbent.

This can serve to provide additional cooling on warm days, by saturating the drape 20 with water or other evaporative fluid, and allowing the moisture to evaporate, thus cooling the air immediately adjacent the back of the neck of a person wearing the present hat and drape 10. It will also be seen that a scent could be added to the drape 20, either alone or with another moisturizing liquid, and allowed to evaporate in order to impart a pleasant scent to the immediate area.

The drape 20 may also include display means thereon, as shown in FIGS. 1 and 2. In FIG. 1, a two dimensional (flat) display 26 is provided on the back of the drape 20. (While this display 26 represents a text message, it should be understood that virtually any type of text, graphic, or pictorial display may be provided at any point or area of the drape 20.) In FIG. 2, a three dimensional (raised, or relief) display 28 is provided, as shown by the raised area 28 shown in section on the drape 20. Again, such raised display means 28 could be in the form of text, graphics, and/or pictorial display, over any or all portions of the drape 20. Such display means 26 and/or 28 would prove very effective, due to their positioning at essentially the eye level of other persons.

The hat 10 may include means for folding or retracting a portion or all of the drape 20, as desired. In FIG. 1, a pair of ties 30 is shown depending from the lower edge of the drape 20, which ties 30 may be used to tie up the length of the drape 20 to shorten the effective length as desired. (It will be understood that additional ties, not shown, could be provided as required.) These ties 30 could secure the drape 20 to some point on the brim 12 (e.g., buttons, passages, etc.). FIG. 2 discloses a similar arrangement, with a tie 32 depending from the underside of the brim 12. (Additional ties, not shown, could be provided about the brim 12, including the unshown portion of the hat 10 of the sectional view of FIG. 2.) A similar arrangement could be used to adjust the width of the drape 20, at least for its lower portions which are not attached to the outer edge 16 of the brim 12.

It is anticipated that the drape 20 would normally be formed of relatively lightweight materials, e. g., a light woven fabric, as noted further above. In breezy conditions, the drape 20 may flap or flutter in the breeze to an undesirable extent. Also, if means are provided for tying up the drape 20 to shorten its length, the very light weight of such fabric material may resist extension when the ties or other securing means are released. Accordingly, it may be desirable to place some small amount of weight within the lower edge of the drape 20.

FIG. 2 discloses such a configuration, with the lower edge 34 of the drape 20 including a pocket formed within the seam thereof, with an elongate weight or a series of small weights 36 being sewn into the seam pocket. (Preferably two or more relatively small weights 36 are provided, to allow the desired flexibility of the lower edge 34 of the drape 20.) The weight(s) 36 need not be particularly heavy, e. g., on the order of an ounce or so would be sufficient, depending upon the total length, width, and area of the drape 20.

Figure 3:
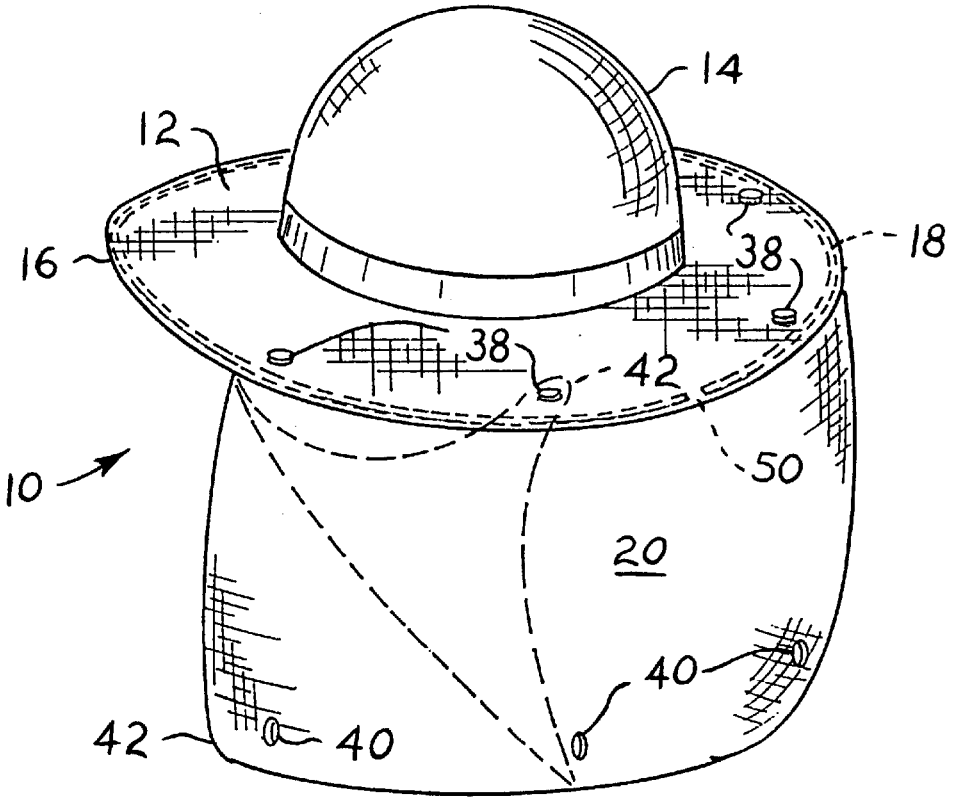
FIG. 3 is a perspective view of another embodiment of the present hat with brim and drape, showing further means for adjusting the position of the drape.
Figure 4:
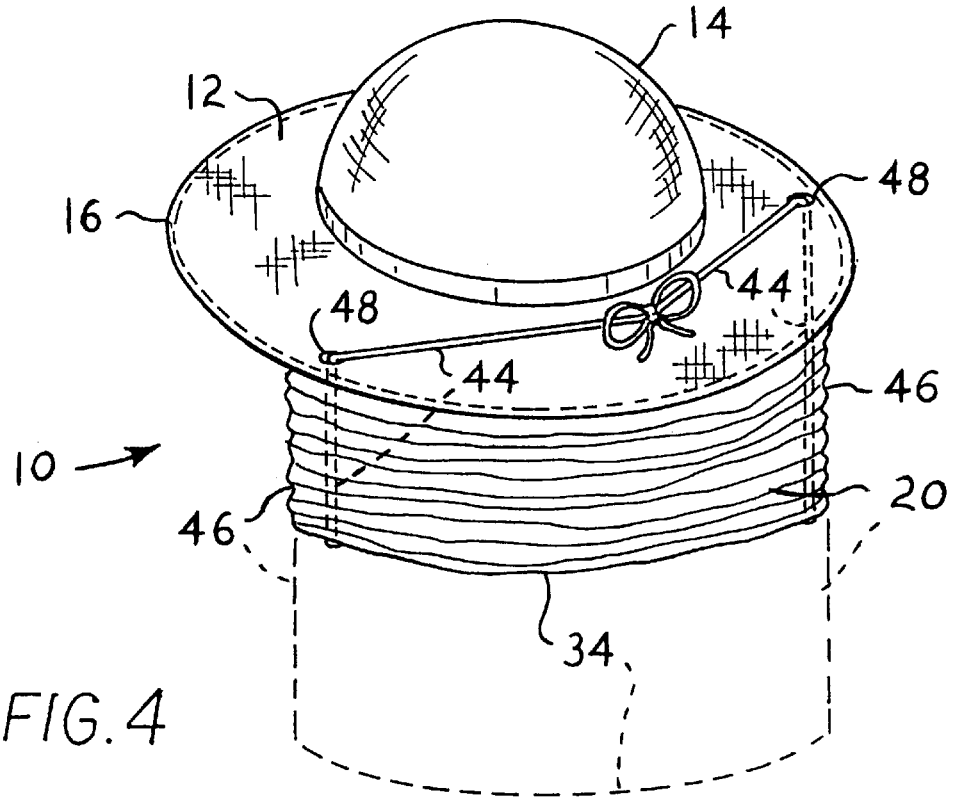
FIG. 4 is a perspective view of yet another embodiment of the present hat and drape, showing further means for adjusting the length of the drape as desired.

Such weights may be incorporated with other means for adjusting the length and width of the drape 20, as shown in FIGS. 3 and 4. In FIG. 3, the outer edge 16 of the hat brim 12 includes a series of buttons 38 therealong, with the lower edge 34 of the drape 20 including a corresponding plurality of buttonholes 40 formed therealong. (Other means, e. g., snaps, mating hook and loop fastening material, etc., may be used to secure the length of the drape 20 as desired.)

It will be seen that the button 38 and buttonhole 40 arrangement of FIG. 3 may be used to secure the drape 20 in configurations other than merely raising the entire drape 20. In FIG. 3, one corner 42 of the drape 20 is shown in a raised position in broken lines, by securing that corner 42 to one of the buttons 38 along the outer edge 16 of the brim 12. One or both drape corners may be secured in a similar manner, and/or other areas of the drape secured to other areas of the brim 12, in other than a vertical, linear manner to arrange the drape 12 as desired.

FIG. 4 discloses another means of adjusting the vertical length of the drape 20. In FIG. 4, a plurality of ties 44 extend downwardly along each lateral edge 46 of the drape 20, and terminate at the lower edge 34 thereof. These ties 44 extend upwardly through passages 48 formed through the brim 12 of the hat 10. The length of the drape 20 may be adjusted by drawing the ties 44 upwardly through the brim passages 48, thus gathering the drape 20 material beneath the outer edge 16 of the brim 12. The ties may be tied together above the brim 12, as shown in FIG. 4, to secure the drape 20 at the length desired.

It will be seen that any of the above described means for raising and lowering the length of the drape 20, may also be used to adjust the width of the drape 20 as desired. For example, a draw string could be placed laterally in the drape 20, immediately below the outer edge 16 of the brim 12, and drawn to gather the lateral width of the drape 20 as desired. Buttons, snaps, hook and loop material, etc., may be used to provide a similar function.

Given the various means described above for adjusting the length and/or width of the drape 20, it will be seen that the drape 20 may be formed to have any practicable length and width desired. For example, it might be desired to form the drape to have only a relatively short length, so no additional means is required to gather the drape to provide a shorter length. On the other hand, the drape 20 could be formed more in the manner of a veil, having a length substantially equal to that of a standing person wearing the hat 10. The means described above could be used to gather the drape 20 to shorten its effective length as desired.

In a similar manner, the drape could be provided with a very narrow width, forming more of a decoration at the back (or one or more sides, etc.) of the brim 12. Such a narrow width would not require any significant width adjusting means. However, the drape could be formed to extend substantially most (or even all) of the way about the periphery of the brim 12, if desired, with means (draw strings, buttons, hook and loop fastening material, etc.) being used to gather the drape to a narrower width as desired.

Figure 5A:
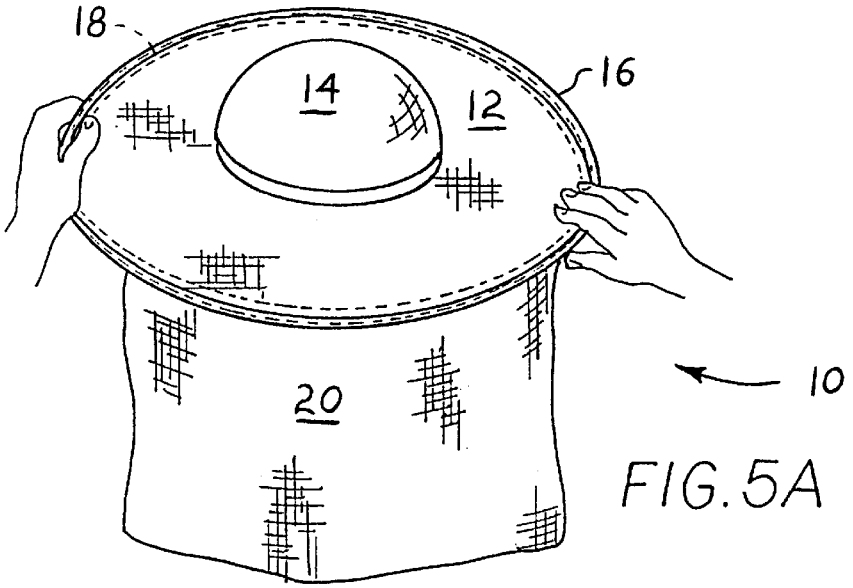
FIG. 5A is a rear perspective view showing a first step in the twist folding of the hat and brim.
Figure 5B:
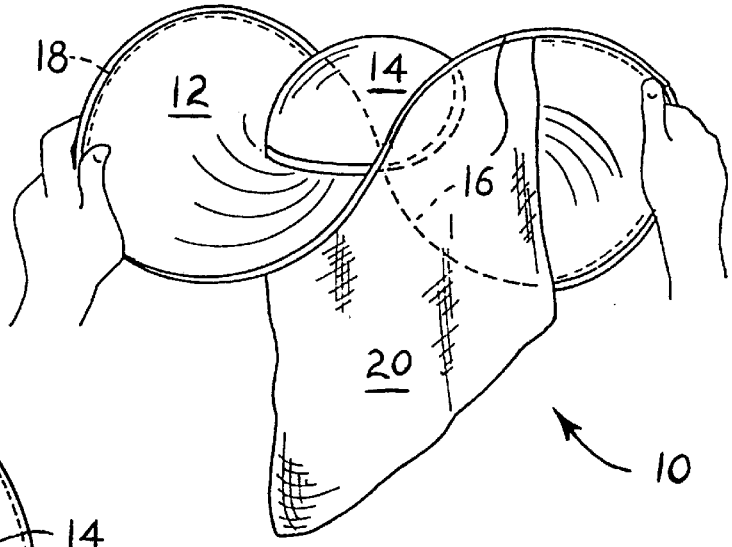
FIG. 5B is a rear perspective view of the second step in the twist folding of the hat and brim.
Figure 5C:
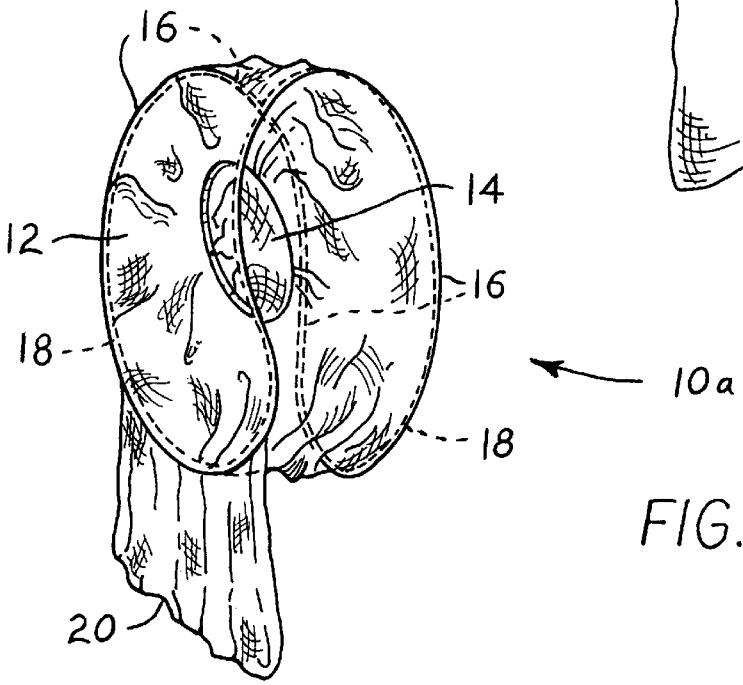
FIG. 5C is a perspective view of the third step in the twist folding of the hat and brim, showing an essentially completely folded hat, brim, and drape.

FIGS. 5A through 5C provide a series of views showing the twist folding of the present hat 10 for storage. In FIG. 5A, the outer edge or rim 16 of the brim 12 is grasped on opposite sides by the hands. The brim 12 is twisted, so the stiff, flexible band or member 18 disposed within the outer edge 16 forms a figure eight shape, as shown in FIG. 5B. The FIG. 8 form is doubled over by bringing the hands together, to form the compact folded hat shape 10*a*, shown in FIG. 5C.

The stiff, flexible band or member 18 may be in the form of a single, endless, continuous band, or may have the two ends connected together but free to rotate axially relative to one another to facilitate the twisting and folding of the band 18 and hat brim 12. Various means of locking the two ends of the band 18 together while permitting independent axial rotation have been developed in the past. Perhaps the simplest means of doing so is by merely providing a gap 50 between the two ends within the brim periphery 16, as shown in broken lines in FIG. 3. The peripheral pocket formed within the brim periphery 16 serves to retain the two separate ends of the flexible band 18 in close proximity to one another. Reinforcement (not shown) of the peripheral brim pocket in the area of the gap 50 may be provided, in order to preclude either of the ends from working outwardly through the brim periphery 16. Other means for providing for the independent axial rotation of each end of the band 18 may be provided, such as those means disclosed in the prior art.

In summary, the present hat with twist folding brim and drape will be seen to provide a most useful accessory for persons who have occasion to work or engage in outdoor activities. The drape of the present hat works well to protect the wearer from the sun, with the drape capable of being formed to any practicable length and/or width as desired. Means are provided for adjusting the length and/or width of the drape as desired, depending upon the ambient conditions and the desires of the person wearing the present hat.

The present hat and drape provide a novel means of protecting at least the back of the neck of a person wearing the present hat, depending upon the length and width of the drape provided. As the drape is disposed somewhat away from the skin and clothing of the wearer by means of the width of the brim of the hat, the drape does not come into substantial contact with the skin or clothing of the wearer, and provides space for air circulation between the wearer and the drape. Yet, the drape provides significant shading and protection from the sun, rain, and other environmental effects.

Innumerable different materials may be used to form the drape, depending upon the water resistance, absorbency, reflectivity, decorative nature, etc. desired for the drape. Absorbent materials provide an additional function, in that they may be saturated with water or other evaporative liquid, with the evaporation of the liquid serving to cool the immediate area in the vicinity of at least the back of the neck of a person wearing the present hat and saturated drape. Scents may be added to such an absorbent drape, in addition to or instead of other evaporative liquid, to impart a pleasing scent to the surrounding area.

The present drape is well suited for providing some form of display thereon, as the display is situated essentially at eye level for most persons when another person is wearing the present hat with display means disposed near the upper portion of the drape. Such display means may provide advertising or any other message or display desired, in either two or three dimensional form, and in text, graphic, and/or pictorial form, as desired.

Accordingly, the present hat with its brim and peripheral drape will provide significant utility for all persons engaged in any outdoor activity, including gardening, visits to the beach or amusement park, etc. The display means provided on the drape may be used to advertise an amusement park, tourist area, etc., or may be personalized with a name or other message of importance to the wearer. The present hat with its drape and twist folding brim could be constructed of relatively inexpensive materials with some form of advertising displayed on the drape thereof, and distributed by amusement parks, gardening and landscaping facilities, etc. in order to spread the word of their facility or operation.

Alternatively, the present hat with its twist folding brim and drape could be constructed of relatively durable and long lasting materials, to provide innumerable wearings for the owner thereof over a long period of service. The twist fold band and brim of the present hat will be of significant utility in such a durable hat, providing for the compact storage of the hat in a diameter significantly less than half that of the expanded brim. While the double folding of the present hat was illustrated in FIGS. 5A through 5C, it will be understood that the flexible band of the present hat also permits more than two loops to be formed, for even more compact storage. Such a twist folded hat could be stored in any practicable location (purse, automobile glove box, etc.) until needed for further use. Thus, the utility and versatility of the present hat with its drape and twist folding brim is limited only by the needs and imagination of the user.

It is to be understood that the present invention is not limited to the embodiments described above, but encompasses any and all embodiments within the scope of the following claims.

I claim:

1. Headgear, comprising:

a hat having a crown, with a brim completely encircling said crown;

said brim including an outer peripheral edge, with a stiff, flexible member disposed within said outer peripheral edge of said brim for twist folding said brim for compactly storing said hat as desired;

a drape attached to and depending from said outer peripheral edge of said brim, said drape having a length and a width; and said width extending at least partially about said outer periphery of said brim;

wherein said brim and said drape contain cooperative means for adjusting said length of said drape and said width of said drape.

2. The headgear according to claim 1, wherein said drape is permanently secured to said brim.

3. The headgear according to claim 1, wherein said drape is removably secured to said brim, and said brim includes means for removably attaching said drape thereto.

4. The headgear according to claim 1, wherein said drape includes a lower edge, with said lower edge including weight means therein for drawing said drape fully downwardly.

5. The headgear according to claim 1, wherein said drape is formed of waterproof material.

6. The headgear according to claim 1, wherein said drape is formed of moisture absorbent material, for saturating with moisture for evaporative cooling and dispensing of moisture therefrom.

7. The headgear according to claim 1, wherein said drape includes display means disposed thereon, with said display means being selected from the group consisting of two dimensional display means and three dimensional display means.

8. The headgear according to claim 1, wherein said cooperative means includes at least one member selected from the group consisting of a drawstring, button, snap, or hook and loop fastener.

* * * * *